United States Patent [19]

Bear

[11] 4,350,344

[45] Sep. 21, 1982

[54] APPARATUS FOR PLAYING A COMPETITIVE GAME

[76] Inventor: Michael L. Bear, 1900 Pidgeon Point Rd., Beaufort, S.C. 29902

[21] Appl. No.: 235,783

[22] Filed: Feb. 19, 1981

[51] Int. Cl.[3] ..... A63B 67/10

[52] U.S. Cl. ..... 273/333; 273/357; 273/393; 273/399; 273/413

[58] Field of Search ..... 273/85 D, 331, 333, 273/334, 355, 356, 357, 393, 399, 413

[56] References Cited

U.S. PATENT DOCUMENTS

| | | | |
|---|---|---|---|
| 86,337 | 1/1869 | Zink . | |
| 828,825 | 8/1906 | Martin . | |
| 966,056 | 8/1910 | Root | 273/334 |
| 1,549,848 | 8/1925 | Sexton | 273/393 |
| 1,634,016 | 6/1927 | Brown . | |
| 2,083,850 | 6/1937 | Macy | 273/331 |
| 3,312,470 | 4/1967 | Ames . | |
| 3,441,278 | 4/1969 | Edwards | 273/399 X |
| 3,770,273 | 11/1973 | Reiner | 273/333 |
| 3,930,649 | 1/1976 | Yackel | 273/331 |
| 3,936,050 | 2/1976 | Hornsby | 273/85 D |
| 3,966,208 | 6/1976 | Gohsler | 273/331 |
| 3,985,358 | 10/1976 | Hamano . | |
| 4,021,039 | 5/1977 | Hay | 273/85 B |

FOREIGN PATENT DOCUMENTS

| | | | |
|---|---|---|---|
| 455338 | 1/1928 | Fed. Rep. of Germany | 273/356 |

*Primary Examiner*—Anton O. Oechsle
*Attorney, Agent, or Firm*—John J. Byrne

[57] ABSTRACT

Disclosed is apparatus for playing a competitive game comprising (a) a playing board having a first player's station at one end and a second player's station at the opposite end, (b) an upright standard centrally mounted on the playing board, (c) a weight which is connected to the upright standard at a point remote from the playing board, but which is permitted to rotate about the upright standard, (d) at least one target mounted on the playing board in position to be contacted by the weight, and (e) a mallet mounted at each of the player's stations by means permitting the mallet to be both pivoted and moved longitudinally. The mallets are used to strike the weight, thereby causing it to rotate about the upright standard and to contact the target.

42 Claims, 7 Drawing Figures

APPARATUS FOR PLAYING A COMPETITIVE GAME

TECHNICAL FIELD

This invention relates to apparatus for playing competitive games. In particular, it relates to apparatus for playing a table-top, tetherball-type competitive game.

BRIEF SUMMARY OF THE INVENTION

This invention comprises apparatus for playing a table-top, tetherball-type competitive game. The apparatus comprises (a) a playing board having a first player's station at one end and a second player's station at the opposite end, (b) an upright standard centrally mounted on the playing board, (c) a weight which is connected to the upright standard at a point remote from the playing board, but which is permitted to rotate about the upright standard, (d) at least one target mounted on the playing board in position to be contacted by the weight, and (e) a mallet mounted at each of the player's stations by means permitting the mallet to be both pivoted and moved longitudinally. The mallets are used to strike the weight, thereby causing it to rotate about the upright standard and to contact the target.

DETAILED DESCRIPTION OF THE PRESENTLY PREFERRED EMBODIMENTS OF THE INVENTION

First Embodiment

Figure 1:
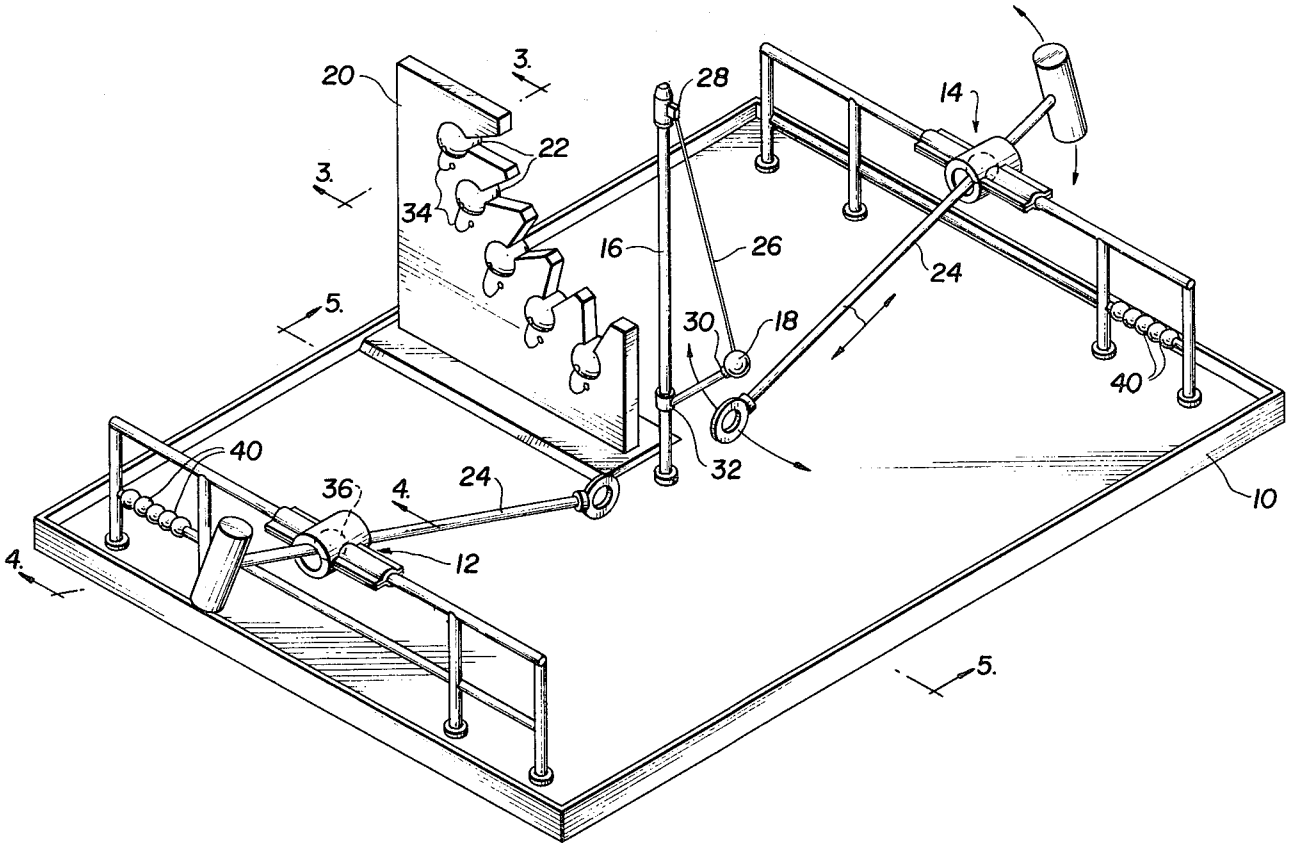
FIG. 1 is a perspective view of a first embodiment of the invention.
Figure 2:
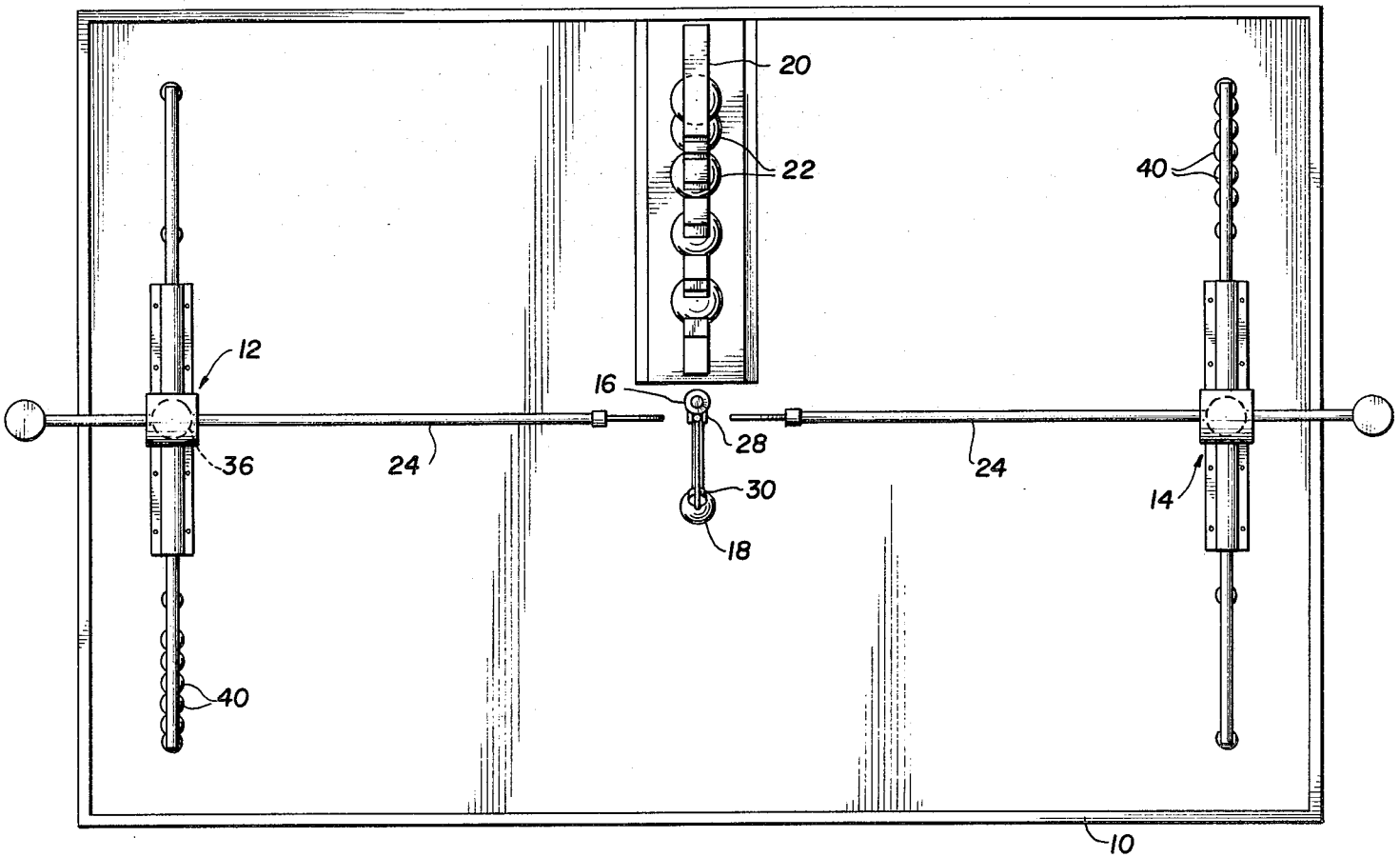
FIG. 2 is a top plan view of the first embodiment of the invention.
Figure 3:
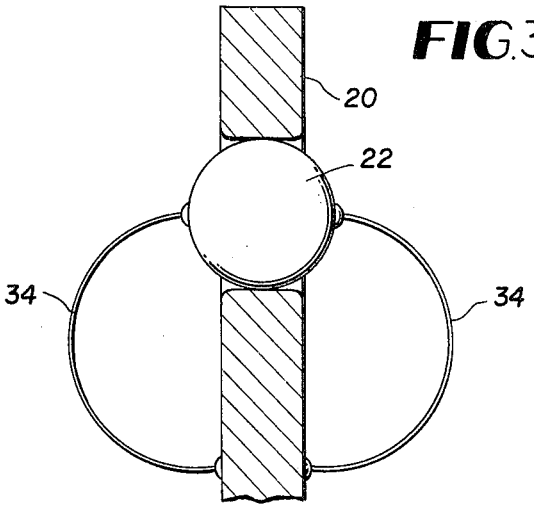
FIG. 3 is a view along the line 3—3 in FIG. 1.

The first embodiment of the invention is shown in FIGS. 1 through 5. It comprises a playing board 10 having a first player's station 12 at one end and a second player's station 14 at the opposite end, an upright standard 16 centrally mounted on the playing board 10, a spherical weight 18 which is connected to the upright standard 16 at a point remote from the playing board 10, but which is permitted to rotate about the upright standard 16, a target holder 20 centrally mounted on the playing board 10, at least one (in the illustrated embodiment, five) target 22 mounted on the target holder 20 in position to be struck by the weight 18, and a mallet 24 mounted at each of the player's stations 12 and 14. Each of the mallets 24 is mounted for both pivotal and longitudinal motion relative to the associated one of the player's stations. Accordingly, the mallets 24 can be used to strike the weight 18, thereby causing it to rotate about the upright standard 16 and to strike the target 22. Moreover, each mallet 24 has a weight-engaging paddle-shaped surface 23 which has a centrally positioned through-hole 25 which is slightly smaller in diameter than the weight 18. The through-hole 25 can be used to "carry" the weight 18, thereby giving the player more control over movement of the weight. However, it should be realized that the word "mallet" is used in its broadest sense, and the mallet used in this game can have many shapes other than the specific shape illustrated.

As illustrated, the weight 18 is preferably connected to the upright standard 16 by a flexible cord 26. The flexible cord is attached to a member 28 which is rotatably mounted on the upright standard 16, thereby allowing the weight 18 to rotate repeatedly around the upright standard 16 without wrapping itself around the upright standard 16.

The apparatus further comprises a serving platform 30 mounted on the upright standard 16 in position to be struck by one of the mallets 24. The serving platform 30 is preferably mounted on a member 32 which is pivotably mounted on the upright standard 16 for pivotal movement in a plane parallel to the board 10, whereby the serving platform 30 can be pivoted into position to hold the weight 18 in position to be struck by either one of the mallets 24.

The serving platform 30 is also mounted for pivotal movement in a plane containing the upright standard 16, thereby allowing the serving platform 30 to pivot from a use position, in which it supports the weight 18 in position to be struck by one of the mallets 24, to a rest position, in which the serving platform is substantially out of the way of the weight 18 during play. Preferably the serving platform 30 pivots freely, whereby it will hold the weight 18 in a position of unsteady equilibrium, but, when the position of unsteady equilibrium is disturbed, the serving platform 30 will drop into the rest position.

The targets 22 are similarly mounted on the target holder 20 in positions of unsteady equilibrium, whereby the targets 22 may be knocked off of or out of the target holder 20 when hit by the weight 18. Means 34 connecting the target 22 to the target holder 20 are provided to facilitate repositioning of the targets 22 at the end of play and to minimize the risk of loss of the targets 22.

Figure 4:
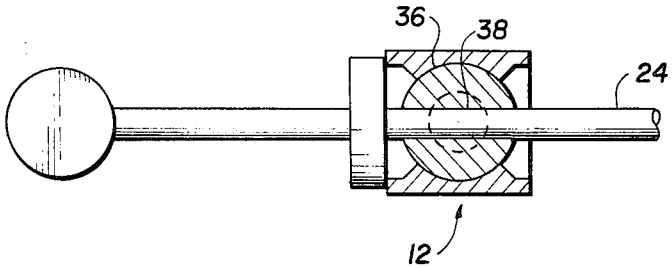
FIG. 4 is a view along the line 4—4 in FIG. 1.
Figure 5:
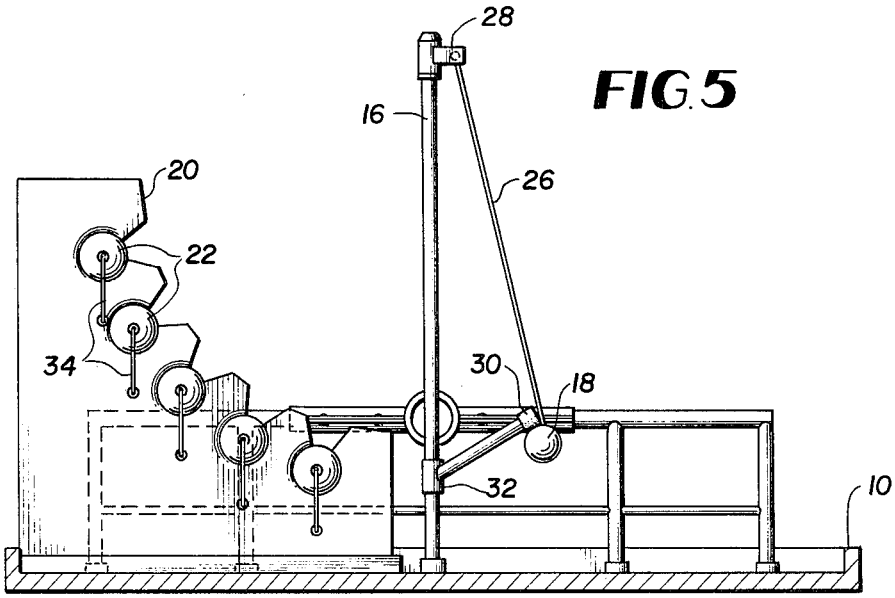
FIG. 5 is a view along the line 5—5 in FIG. 1.

As best seen in FIG. 4, the mallets 24 are mounted at the player's stations 12 and 14 by means comprising a universal joint 36 having a central bore 38 which receives the associated mallet 24. The universal joint 36 and the central bore 38 permit the mallets 24 to be moved longitudinally and pivotably relative to the board 10, but do not permit it to be moved transversely relative to the board 10.

Means 40 are provided at the player's stations 12 and 14 for keeping track of how many targets 22 the player at that end of the board 10 has knocked off of or out of the target holder 20.

Second Embodiment

Figure 6:
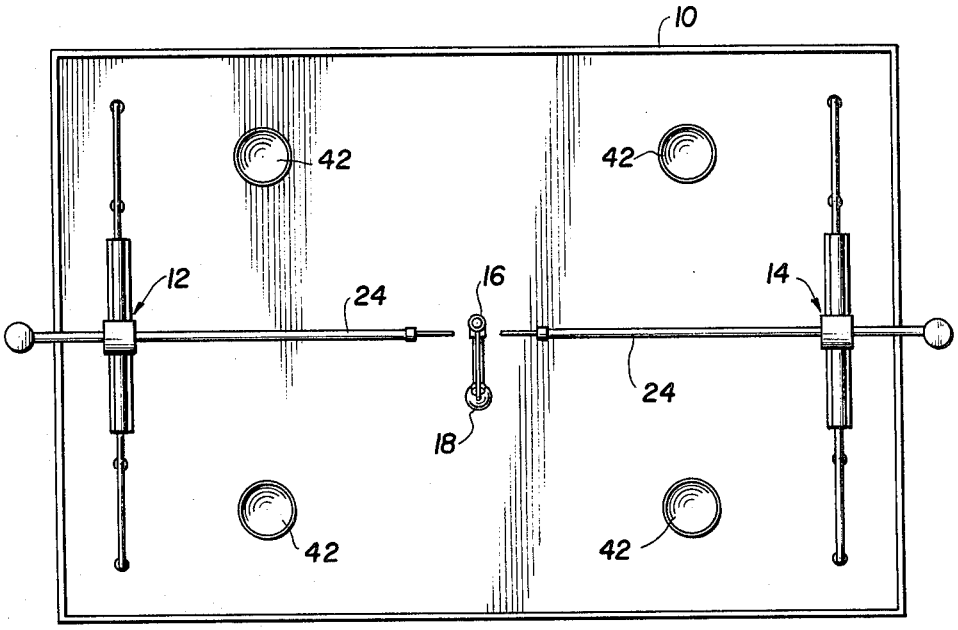
FIG. 6 is a top plan view of a second embodiment of the invention.
Figure 7:
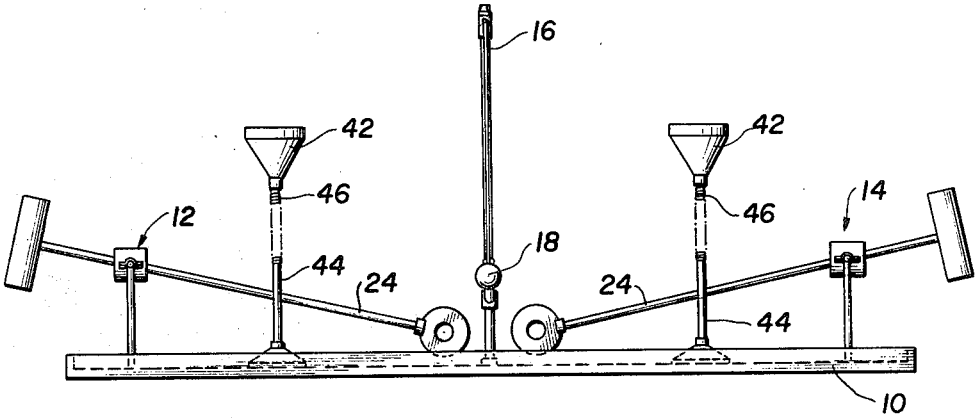
FIG. 7 is a side view of the second embodiment of the invention.

The second embodiment of the invention is shown in FIGS. 6 and 7. It is generally similar to the first embodiment, and the same parts numbers are used to designate corresponding parts in the second embodiment where appropriate. The second embodiment differs from the first embodiment, however, with respect to the targets and the way in which the weight 18 contacts the targets.

The second embodiment comprises at least one (in the illustrated embodiment, four) cups 42 each one of which is mounted on an upright standard 44 in position to receive the weight 18 when the mallets 24 are used to strike the weight 18, thereby causing the weight 18 to rotate about the upright standard 16 and to be received in one of the cups 42. In the illustrated embodiment, the apparatus comprises a plurality of the cups 42 which are positioned equidistantly from the upright standard 16. Optionally, the cups 42 can be resiliently mounted on springs 46, as shown at the right in FIG. 7, thereby permitting the cups 42 to sway and to move vertically when struck by the weight 18.

Caveat

While the present invention has been illustrated by a detailed description of two preferred embodiments thereof, it will be obvious to those skilled in the art that various changes in form and detail can be made therein without departing from the true scope of the invention. For that reason, the invention must be measured by claims appended hereto and not by the foregoing preferred embodiments.

I claim:

1. Apparatus for playing a competitive game, said apparatus comprising:

(a) a playing board having a first player's station at one end and a second player's station at the opposite end;

(b) an upright standard centrally mounted on said playing board;

(c) a weight (i) which is connected to said upright standard at a point remote from said playing board, and (ii) which is permitted to rotate about said upright standard;

(d) a target holder centrally mounted on said playing board;

(e) at least one target mounted on said target holder in position to be struck by said weight;

(f) a mallet mounted at each of said player's stations, each of said mallets being mounted for both pivotal and longitudinal motion relative to the associated one of said player's stations; and (g) a serving platform mounted on said upright standard in position to hold said weight in position to be struck by one of said mallets, whereby said mallets can be used to strike said weight, thereby causing it to rotate about said upright and to strike said target.

2. Apparatus for playing a competitive game, said apparatus comprising:

(a) a playing board having a first player's station at one end and a second player's station at the opposite end;

(b) an upright standard centrally mounted on said playing board;

(c) a weight (i) which is connected to said upright standard at a point remote from said playing board, and (ii) which is permitted to rotate about said upright standard;

(d) a target holder centrally mounted on said playing board;

(e) at least one target mounted on said target holder in position to be struck by said weight; and (f) a mallet mounted at each of said player's stations, each of said mallets (i) being mounted for both pivotal and longitudinal motion relative to the associated one of said player's stations and (ii) having a weight-engaging paddle shaped surface provided with a through-hole which is slightly smaller than said weight, whereby said mallets can be used to strike said weight, thereby causing it to rotate about said upright and to strike said target and said through-hole can be used to "carry" said weight, thereby giving the players more control over movement of said weight.

3. Apparatus as recited in claims 1 or 2 wherein said weight is connected to said upright standard by a flexible cord.

4. Apparatus as recited in claim 2 wherein said flexible cord is attached to a member which is rotatably mounted on said upright standard.

5. Apparatus as recited in claims 1 or 2 wherein said weight is attached to a member which is rotatably mounted on said upright standard.

6. Apparatus as recited in claim 1 wherein said serving platform is mounted on a member which is pivotably mounted on said upright standard for pivotal movement in a plane parallel to said board, whereby said serving platform can be pivoted into position to hold said weight in position to be struck by either one of said mallets.

7. Apparatus as recited in claims 1 or 6 wherein said serving platform is mounted for pivotal movement in a plane containing said upright standard, whereby said serving platform can pivot from a use position, in which said serving platform supports said weight in position to be struck by one of said mallets, to a rest position, in which said serving platform is substantially out of the way of said weight during play.

8. Apparatus as recited in claim 7 wherein:

(a) said weight is connected to said upright standard by a flexible cord and (b) said serving platform pivots freely in a plane containing said upright member, whereby said serving platform will hold said weight in a position of unsteady equilibrium, but, when the position of unsteady equilibrium is disturbed, said serving platform will drop into the rest position.

9. Apparatus as recited in claims 1 or 2 wherein said at least one target is mounted on said target holder in a position of unsteady equilibrium, whereby said target may be knocked off of or out of said target holder when hit by said weight.

10. Apparatus as recited in claim 9 and further comprising means connecting said at least one target to said target holder.

11. Apparatus as recited in claims 1 or 2 wherein each of said mallets is mounted at the associated one of said player's stations by means comprising a universal joint having a central bore which receives said mallet.

12. Apparatus for playing a competitive game, said apparatus comprising:

(a) a playing board having a first player's station at one end and a second player's station at the opposite end;

(b) a first upright standard centrally mounted on said playing board;

(c) a weight (i) which is connected to said first upright standard at a point remote from said playing board, and (ii) which is permitted to rotate about said first upright standard;

(d) at least one cup mounted on a second upright standard in position to receive said weight;

(e) a mallet mounted at each of said player's stations, each of said mallets being mounted for both pivotal and longitudinal motion relative to the associated one of said player's stations; and (f) a serving platform mounted on said first upright standard in position to hold said weight in position to be struck by one of said mallets, whereby said mallets can be used to strike said weight, thereby causing it to rotate about said first upright standard and to be received in said at least one cup.

13. Apparatus for playing a competitive game, said apparatus comprising:

(a) a playing board having a first player's station at one end and a second player's station at the opposite end;

(b) a first upright standard centrally mounted on said playing board;

(c) a weight (i) which is connected to said first upright standard at a point remote from said playing board, and (ii) which is permitted to rotate about said first upright standard;

(d) at least one cup mounted on a second upright standard in position to receive said weight; and (e) a mallet mounted at each of said player's stations, each of said mallets (i) being mounted for both pivotal and longitudinal motion relative to the associated one of said player's stations and (ii) having a weight-engaging paddle shaped surface provided with a through-hole which is slightly smaller than said weight, whereby said mallets can be used to strike said weight, thereby causing it to rotate about said upright and to strike said target, and said through-hole can be used to "carry" said weight, thereby giving the player more control over movement of said weight.

14. Apparatus as recited in claims 12 or 13 wherein said weight is connected to said first upright standard by a flexible cord.

15. Apparatus as recited in claim 14 wherein said flexible cord is attached to a member which is rotatably mounted on said first upright standard.

16. Apparatus as recited in claims 12 or 13 wherein said weight is attached to a member which is rotatably mounted on said first upright standard.

17. Apparatus as recited in claim 12 wherein said serving platform is mounted on a member which is pivotably mounted on said first upright standard for pivotal movement in a plane parallel to said board, whereby said serving platform can be pivoted into position to hold said weight in position to be struck by either one of said mallets.

18. Apparatus as recited in claims 12 or 17 wherein said serving platform is mounted for pivotal movement in a plane containing said first upright standard, whereby said serving platform can pivot from a use position, in which said serving platform supports said weight in position to be struck by one of said mallets, to a rest position, in which said serving platform is substantially out of the way of said weight during play.

19. Apparatus as recited in claim 18 wherein:

(a) said weight is connected to said upright standard by a flexible cord and (b) said serving platform pivots freely in a plane containing said first upright member, whereby said serving platform will hold said weight in a position of unsteady equilibrium, but, when the position of unsteady equilibrium is disturbed, said serving platform will drop into the rest position.

20. Apparatus as recited in claims 12 or 13 wherein said apparatus comprises a plurality of said cups, each one of which is mounted on one of said second upright standards in position to receive said weight.

21. Apparatus as recited in claim 20 wherein said cups are positioned equidistantly from said first upright standard.

22. Apparatus as recited in claims 12 or 13 wherein each of said mallets is mounted at the associated one of said player's stations by means comprising a universal joint having a central bore which receives said mallet.

23. Apparatus as recited in claims 12 or 13 wherein said second upright standard comprises a spring.

24. Apparatus for playing a competitive game, said apparatus comprising:

(a) a playing board having a first player's station at one end and a second player's station at the opposite end;

(b) an upright standard mounted on said playing board intermediate said ends;

(c) a weight;

(d) first means for rotatably mounting said weight on said upright standard at a point remote from said playing board;

(e) a target holder mounted on said playing board intermediate said ends;

(f) at least one target mounted on said target holder in position to be struck by said weight;

(g) a mallet mounted at each of said player's stations, each of said mallets mounted for pivotal and longitudinal motion relative to the associated one of said player's stations;

(h) a serving platform; and (i) second means for supporting said serving platform in position so that said weight can be struck by one of said mallets while it is supported by said serving platform, whereby said mallets can be used to strike said weight, thereby causing it to rotate about said upright and to strike said target.

25. Apparatus for playing a competitive game, said apparatus comprising:

(a) a playing board having a first player's stations at one end and a second player's station at the opposite end;

(b) an upright standard mounted on said playing board intermediate said ends;

(c) a weight;

(d) first means for rotatably mounting said weight on said upright standard at a point remote from said playing board;

(e) a target holder mounted on said playing board intermediate said ends;

(f) at least one target mounted on said target holder in position to be struck by said weight; and (g) a mallet mounted at each of said player's stations, each of said mallets (i) being mounted for pivotal and longitudinal motion relative to the associated one of said player's stations and (ii) having a weight-engaging paddle shaped surface provided with a through-hole which is slightly smaller than said weight, whereby said mallets can be used to strike said weight, thereby causing it to rotate about said upright and to strike said target and said through-hole can be used to "carry" said weight, thereby giving the players more control over movement of said weight.

26. Apparatus as recited in claims 24 or 25 wherein said weight is connected to said first means by a flexible cord.

27. Apparatus as recited in claim 24 wherein said serving platform is mounted on a member which is pivotally mounted on said upright standard for pivotal movement in a plane parallel to said board, whereby said serving platform can be pivoted into position to hold said weight in position to be struck by either one of said mallets.

28. Apparatus as recited in claims 24 or 27 wherein said serving platform is mounted for pivotal movement in a plane containing said upright standard, whereby said serving platform can pivot from a use position, in which said serving platform supports said weight in position to be struck by one of said mallets, to a rest position, in which said serving platform is substantially out of the way of said weight during play.

29. Apparatus as recited in claim 28 wherein:

(a) said weight is connected to said first means by a flexible cord and (b) said serving platform pivots freely in a plane containing said upright member, whereby said serving platform will hold said weight in a position of unsteady equilibrium, but, when the position of unsteady equilibrium is disturbed, said serving platform will drop into the rest position.

30. Apparatus as recited in claims 24 or 25 wherein said at least one target is mounted on said target holder in a position of unsteady equilibrium, whereby said at least one target may be knocked off of or out of said target holder when hit by said weight.

31. Apparatus as recited in claim 30 and further comprising means for connecting said at least one target to said target holder.

32. Apparatus as recited in claims 24 or 25 wherein each of said mallets is mounted at the associated one of said player's stations by means comprising a universal joint having a central bore which receives said mallet.

33. Apparatus for playing a competitive game, said apparatus comprising:

(a) a playing board having a first player's station at one end and a second player's station at the opposite end;

(b) a first upright standard mounted on said playing board intermediate said ends;

(c) a weight;

(d) first means for rotatably mounting said weight on said upright standard at a point remote from said playing board;

(e) at least one cup mounted on a second upright standard in position to receive said weight;

(f) a mallet mounted at each of said player's stations, each of said mallets mounted for pivotal and longitudinal motion relative to the associated one of said player's stations;

(g) a serving platform; and (h) second means for supporting said serving platform in position so that said weight can be struck by one of said mallets while it is supported by said serving platform, whereby said mallets can be used to strike said weight, thereby causing is to rotate about said first upright standard and to be received in said at least one cup.

34. Apparatus for playing a competitive game, said apparatus comprising:

(a) a playing board having a first player's station at one end and a second player's station at the opposite end;

(b) a first upright standard mounted on said playing board intermediate said ends;

(c) a weight;

(d) first means for rotatably mounting said weight on said upright standard at a point remote from said playing board;

(e) at least one cup mounted on a second upright standard in position to receive said weight; and (f) a mallet mounted at each of said player's stations, each of said mallets (i) being mounted for both pivotal and longitudinal motion relative to the associated one of said player's stations and (ii) having a weight-engaging paddle shaped surface provided with a through-hole which is slightly smaller than said weight, whereby said mallets can be used to strike said weight, thereby causing it to rotate about said upright and to strike said target, and said through-hole can be used to "carry" said weight, thereby giving the player more control over movement of said weight.

35. Apparatus as recited in claims 33 or 34 wherein said weight is connected to said first means by a flexible cord.

36. Apparatus as recited in claim 33 wherein said serving platform is mounted on a member which is pivotably mounted on said first upright standard for pivotal movement in a plane parallel to said board, whereby said serving platform can be pivoted into position to hold said weight in position to be struck by either one of said mallets.

37. Apparatus as recited in claims 33 or 36 wherein said serving platform is mounted for pivotal movement in a plane containing said first upright standard, whereby said serving platform can pivot from a use position, in which said serving platform supports said weight in a position to be struck by one of said mallets, to a rest position, in which said serving platform is substantially out of the way of said weight during play.

38. Apparatus as recited in claim 37 wherein:

(a) said weight is connected to said first means by a flexible cord and (b) said serving platform pivots freely in a plane containing said first upright standard, whereby said serving platform will hold said weight in a position of unsteady equilibrium, but, when the position of unsteady equilibrium is disturbed, said serving platform will drop into the rest position.

39. Apparatus as recited in claims 33 or 34 wherein said apparatus comprises a plurality of said cups, each one of which is mounted on one of said second upright standards in position to receive said weight.

40. Apparatus as recited in claim 39 wherein said cups are positioned equidistantly from said first upright standard.

41. Apparatus as recited in claims 33 or 34 wherein each of said mallets is mounted at the associated one of said player's stations by means comprising a universal joint having a central bore which receives said mallet.

42. Apparatus as recited in claims 33 or 34 wherein said second upright standard comprises a spring.

* * * * *